US008403156B1

(12) United States Patent
Boone

(10) Patent No.: US 8,403,156 B1
(45) Date of Patent: Mar. 26, 2013

(54) CANISTER ORGANIZER

(76) Inventor: Ryan K. Boone, Bend, OR (US)

( * ) Notice: Subject to any disclaimer, the term of this patent is extended or adjusted under 35 U.S.C. 154(b) by 101 days.

(21) Appl. No.: 12/965,002

(22) Filed: Dec. 10, 2010

(51) Int. Cl.
*A47B 73/00* (2006.01)
*A47F 5/08* (2006.01)

(52) U.S. Cl. ..... 211/75; 211/87.01

(58) Field of Classification Search ..... 211/75, 211/74, 87.01, 10, 60.1; 220/480, 481, 476, 220/507, 504; 248/311.2, 315, 220.21, 220.31, 248/225.21, 313, 316.1, 316.17, 200, 300
See application file for complete search history.

(56) References Cited

U.S. PATENT DOCUMENTS

| | | | | |
|---|---|---|---|---|
| 1,587,308 | A * | 6/1926 | Hatcher | 40/605 |
| 1,625,359 | A * | 4/1927 | Gerding et al. | 217/19 |
| 1,962,608 | A * | 6/1934 | McEachern | 211/74 |
| 2,145,879 | A * | 2/1939 | Jewett | 211/72 |
| 2,155,884 | A * | 4/1939 | Barnes | 211/74 |
| 2,315,739 | A * | 4/1943 | Sale | 248/300 |
| 2,338,310 | A * | 1/1944 | Barnes | 211/74 |
| 2,473,293 | A * | 6/1949 | Nelson | 248/264 |
| 2,580,676 | A * | 1/1952 | Gross | 211/75 |
| 2,590,415 | A * | 3/1952 | Jenne | 248/66 |
| 2,719,633 | A * | 10/1955 | Rosenberg | 108/109 |
| 2,743,075 | A * | 4/1956 | Johnson | 248/223.41 |
| 2,766,660 | A * | 10/1956 | Laddon et al. | 89/1.51 |
| 3,091,424 | A * | 5/1963 | Yegge | 248/313 |
| 3,239,069 | A | 3/1966 | Hollins | |
| 3,255,722 | A * | 6/1966 | Ferdinand et al. | 108/147.15 |
| 3,331,574 | A * | 7/1967 | Davidson | 248/48.2 |
| 3,365,228 | A * | 1/1968 | Hay | 294/31.2 |
| 3,452,954 | A * | 7/1969 | Lucietto et al. | 248/220.22 |
| 3,552,577 | A * | 1/1971 | Latham | 211/74 |
| 3,985,148 | A * | 10/1976 | Cadman | 135/66 |
| 4,132,380 | A * | 1/1979 | Pastore | 248/224.61 |
| 4,378,889 | A * | 4/1983 | Lebowitz | 211/75 |
| 4,557,456 | A * | 12/1985 | Mueller | 248/499 |
| 4,567,989 | A | 2/1986 | Hurst, Jr. | |
| 5,904,257 | A | 5/1999 | Marmet et al. | |
| 6,047,837 | A * | 4/2000 | Kessens | 211/85.21 |
| 6,497,395 | B1 * | 12/2002 | Croker | 248/300 |
| 6,622,979 | B2 * | 9/2003 | Valiulis | 248/220.42 |
| 6,793,378 | B2 * | 9/2004 | Wu | 362/365 |
| 7,339,549 | B2 * | 3/2008 | Maxwell et al. | 343/892 |
| 7,506,771 | B2 * | 3/2009 | Bianchini | 211/75 |
| D602,314 | S | 10/2009 | Stravitz | |
| 7,757,868 | B2 * | 7/2010 | Bianchini | 211/75 |
| 7,918,433 | B2 * | 4/2011 | Melton et al. | 248/674 |
| 7,987,983 | B1 * | 8/2011 | Guitreau | 206/443 |
| 2001/0013567 | A1 * | 8/2001 | Valiulis | 248/220.41 |
| 2007/0210022 | A1 * | 9/2007 | Bianchini | 211/75 |
| 2009/0101788 | A1 * | 4/2009 | Kidder et al. | 248/674 |
| 2009/0211995 | A1 * | 8/2009 | Bianchini | 211/75 |
| 2011/0290952 | A1 * | 12/2011 | Masters et al. | 248/68.1 |

* cited by examiner

*Primary Examiner* — James O Hansen
*Assistant Examiner* — Kimberley S Wright
(74) *Attorney, Agent, or Firm* — Montgomery Patent & Design LLP; Robert C Montgomery

(57) ABSTRACT

An organizer for storing and displaying a plurality of canisters along a vertical surface includes a support structure and a plurality of wall-mounting brackets. The support structure includes a large rectangular body with a plurality of equally-spaced circular apertures on front and back surfaces, allowing for the insertion of desired cylindrical objects for storage and display. Each of the wall-mounting brackets further provides an outwardly extending tabs facing upwards, thereby allowing a user to set the apertures of the shelf on the brackets for secure mounting.

18 Claims, 7 Drawing Sheets

CANISTER ORGANIZER

RELATED APPLICATIONS

The present invention was first described in a notarized Official Record of Invention on Feb. 22, 2010, that is on file at the offices of Montgomery Patent and Design, LLC, the entire disclosures of which are incorporated herein by reference.

FIELD OF THE INVENTION

The present invention relates generally to storage shelves and racks, and in particular, to an organizer to store and display a plurality of generally cylindrically shaped canisters which can be quickly identified.

BACKGROUND OF THE INVENTION

Spray cans are found in used in almost any industrial and residential environment. They are used to contain and dispense lubricating compounds, cleaning chemicals, paint, and various foodstuffs such as non-stick cooking spray. Such materials can be easily dispensed by simply pressing down on a release button. However, their multitude of uses coupled with their ease of usability also means that there are typically a great number of spray cans present in almost any work or home environment. They are usually stored upon a shelf in a vertical manner in close proximity to one another. This means that when a specific spray can is needed; a large number of other cans may require movement in order to locate and access the desired spray can. This obviously affects productivity and efficiency, which can relate to lost revenue in workplace environments.

Various types of storage shelves and racks exist. Some of these structures are designed to accommodate specific types of containers in a particular manner. Such examples include wine racks, tool shelves, and the like. While such structures may offer particular benefits they suffer from at least one (1) disadvantage or deficiency in design or utilization. For example these structures are typically large and obtrusive. While some provide aesthetic features in an attempt to mitigate their obtrusiveness, they still occupy a lot of room. Additionally, these structures are typically placed on the floor or ground surface which can make cleaning or use of precious floor space difficult.

SUMMARY OF THE INVENTION

The inventor recognized the aforementioned inherent problems and lack in the art and observed that there is a need for a device and method of use by which a plurality of spray cans can be kept in a neat and organized state allowing for rapid identification and ease of use without the disadvantages as described above. It is an object of the present disclosure to solve these problems.

The inventor recognized these problems and has addressed this need by developing a canister organizer which provides a way of holding and displaying a plurality of spray cans in an arrangement that keeps them readily accessible and easily identifiable. The inventor has thus realized the advantages and benefits of providing an organizer for storing and displaying a plurality of canisters having a support structure with a front surface, a rear surface, an opposing pair of side surfaces, a top surface, and a bottom surface, where the structure defines a hollow interior. A plurality of circular front apertures are disposed through the front surface and have a diameter greater than a canister diameter and a corresponding plurality of circular rear apertures are disposed through the rear surface and also have a diameter greater than the canister diameter. The rear apertures are generally aligned with the plurality of front apertures. A first bracket is mounted to a vertical support surface and engages an upper pair of adjacent rear apertures and a second bracket is mounted to the vertical support surface aligned with and below the first bracket for engaging a lower pair of adjacent rear apertures. The support structure is removably mounted to the first bracket and the second bracket in an upright and vertical position, such that when the support structure is in the upright and vertical position canisters can be inserted through the front aperture and into an aligned rear apertures such that each canister is cooperatively supported by the front surface and the rear surface in a generally horizontal position. In such a manner the organizer holds and displays a plurality of spray cans or similar cylindrical containers in an arrangement that keeps them readily accessible and easily identifiable.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 10 | canister organizer |
| 15 | support surface |
| 16 | canister |
| 20 | front surface |
| 21 | front aperture |
| 22 | side surface |
| 23 | rear surface |
| 24 | rear aperture |
| 25 | top surface |
| 26 | bottom surface |
| 27 | label slot |
| 30 | first bracket |
| 31 | first bracket body |

-continued

| DESCRIPTIVE KEY | |
|---|---|
| 32 | first bracket aperture |
| 33 | arcuate member |
| 34 | first bracket tab |
| 40 | second bracket |
| 41 | second bracket structure |
| 42 | second bracket aperture |
| 43 | second bracket tab |
| 44 | arcuate edge |
| 45 | fastener |
| 50 | alternate method of installation |

DETAILED DESCRIPTION OF THE PREFERRED EMBODIMENT

The best mode for carrying out the disclosure is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present disclosure describes a canister organizer (herein described as a "device") 10, which provides for the retention and display of a plurality of canisters 16 such as, but not limited to: spray paint, oil, shaving cream, or similar items. The device 10 includes a rectangular-shape which suspends canisters 16 in an angled manner. The device 10 is preferably suspended to a vertical support surface 15, yet may also be recessed into the vertical surface (see FIG. 7) or placed upon a desired horizontal surface. The device 10 is fabricated from materials such as, but not limited to: wood, plastic, metal, or the like.

Figure 1:
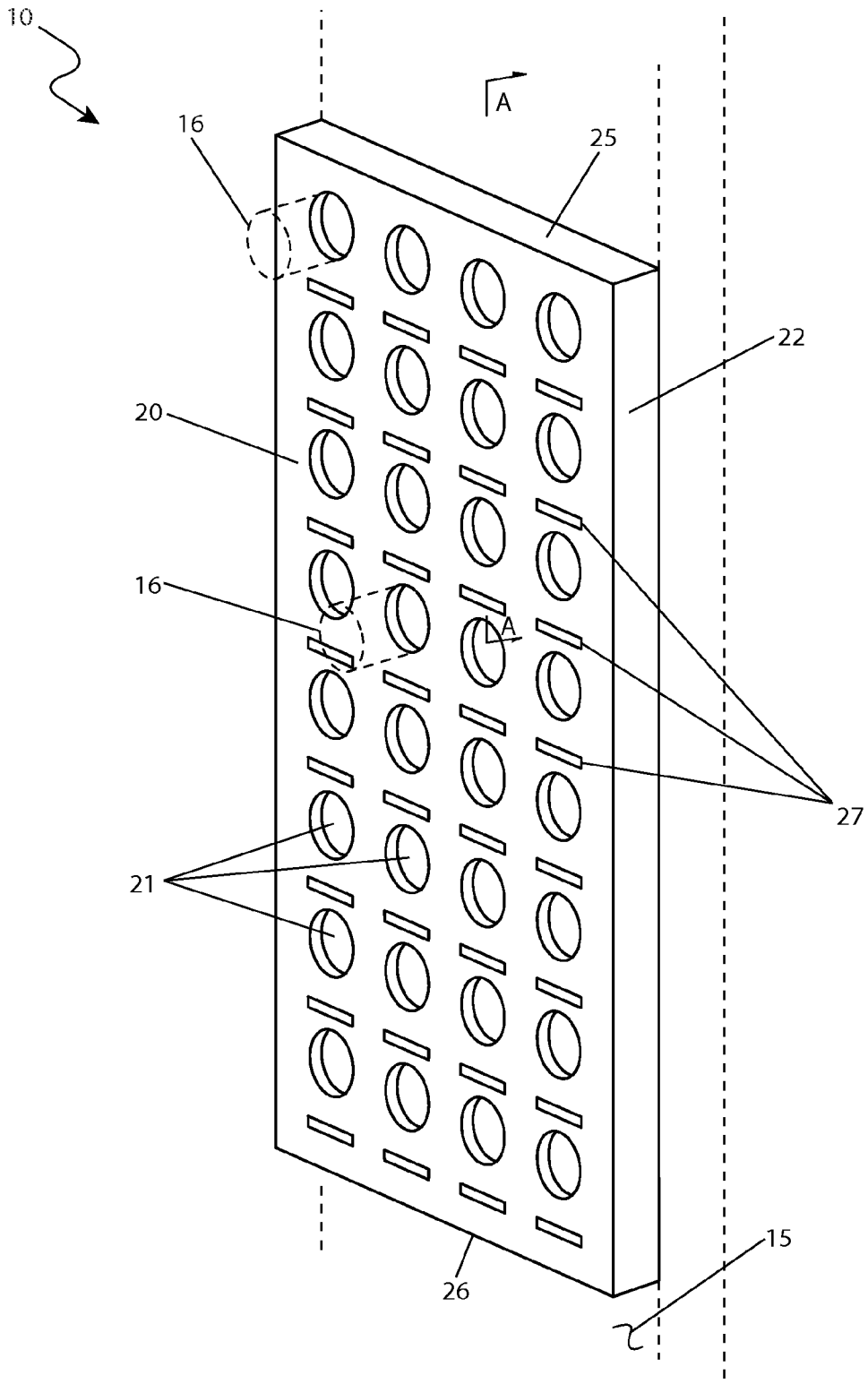
FIG. 1 is an environmental view of a canister organizer 10, according to a preferred embodiment.

Referring now to FIG. 1, an environmental view of the device 10 is disclosed. The device 10 includes a six (6) sided structure having a front surface 20, a pair of side surfaces 22, a rear surface 23, a top surface 25, and a bottom surface 26 which provide for a support structure to suspend canisters 16 on a suitable vertical surface 15 such as, but not limited to: a wall, a door, or the like. The surfaces 20, 22, 23, 25, 26 are preferably integrally molded or rigidly affixed to form a single structure. The front surface 20 also includes a plurality of front apertures 21 which provide for placement of a plurality of canisters 16 which are inserted therein. The front apertures 21 preferably include a four (4) by eight (8) matrix, yet other combinations may be utilized without limiting the scope of the device 10. The front apertures 21 measure approximately three-and-three-eighths (3⅜) inches in diameter which accommodates various diameters of canister 16.

Below each front aperture 21 is a label slot 27 which provides for identification of the contents of the canister 16 supported in an adjacent front aperture 21. The label slot 27 is preferably a transparent plastic top-open member which receives descriptive indicia such as, but not limited to: paint color, brand, or substance within the canister 16 which is illustrated on a slice of paper, card, or the like to enable a user to observe and identify the canisters 16 contents. The label slot 27 is preferably attached to the front surface 20 by adhesive, yet other methods of attachment may be utilized without limiting the scope of the device 10.

Figure 2:
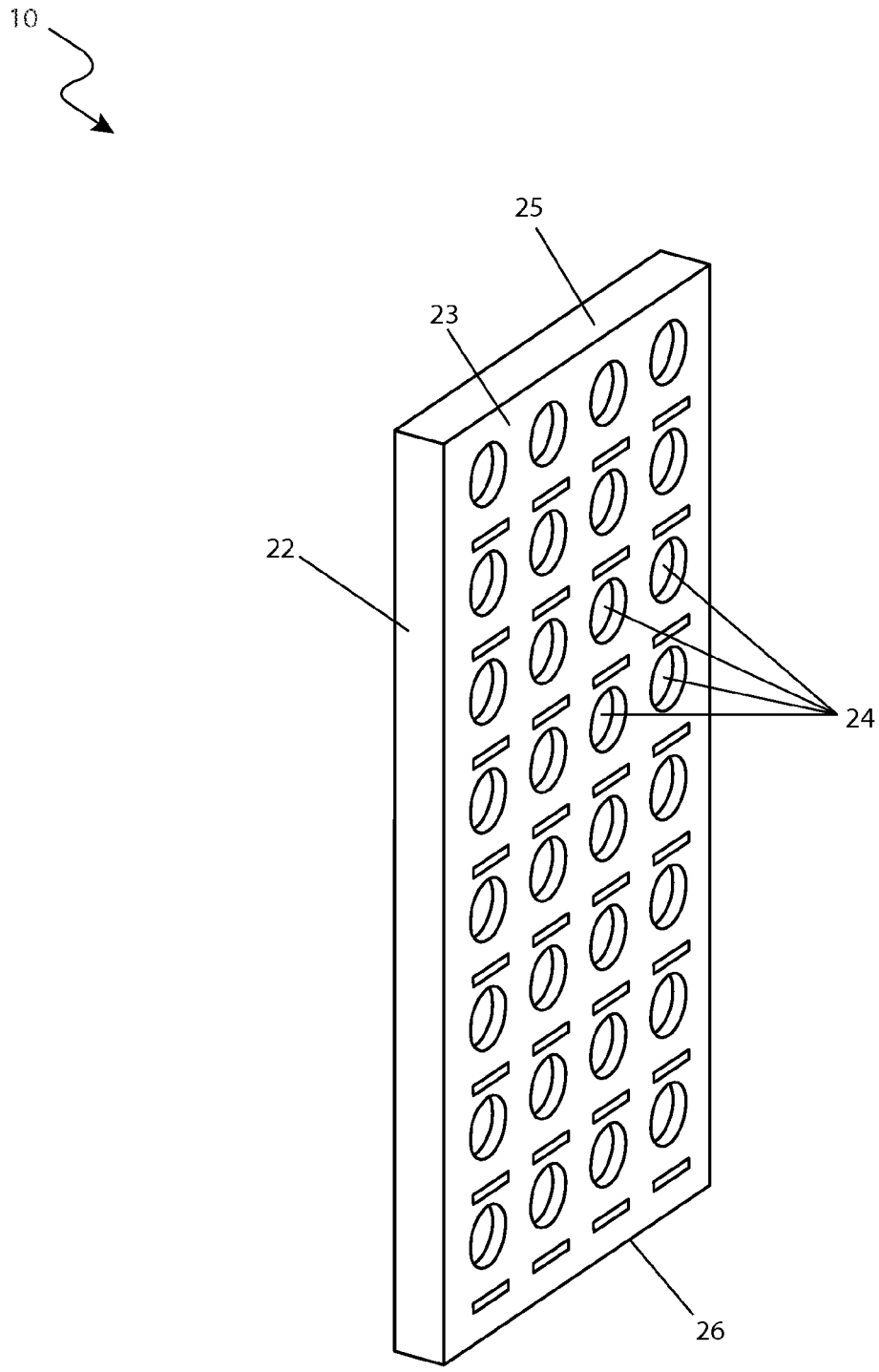
FIG. 2 is a rear perspective view of the canister organizer 10, according to the preferred embodiment.

Referring now to FIG. 2, a rear perspective view of the device 10 is disclosed. The rear surface 23 provides a structure to secure the canisters 16 and suspend the device 10. The rear surface 23 is positioned adjacent and parallel to the vertical support surface 15 when in use. The thickness of the structure is approximately five-and-a-half (5½) inches. The rear surface 23 includes a plurality of rear apertures 24 which receive a bottom end portion of the canister 16. Each rear aperture 24 is slightly downwardly offset from a corresponding front aperture 21 in order to position each canister 16 in a slight downward angle orientation towards the rear surface 23. Each rear aperture 24 is oriented in a matrix similar to the front apertures 21, yet are slightly offset, and they also measure approximately three-and-three-eighths (3⅜) inches in diameter which accommodates various diameters of canister 16 similar to the front apertures 21.

Figure 3:
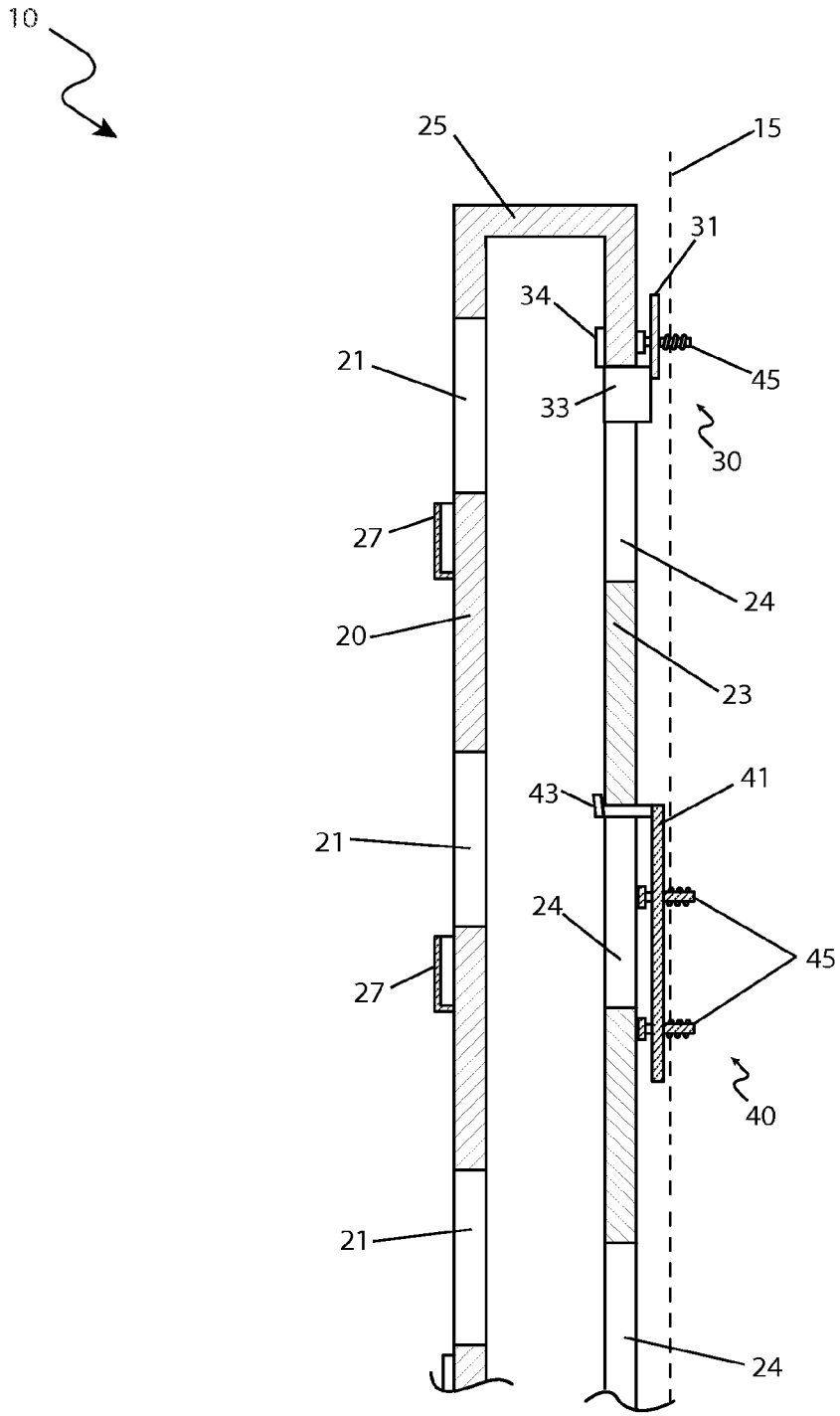
FIG. 3 is a section view of the canister organizer 10 taken along line A-A of FIG. 1, according to the preferred embodiment.
Figure 4:
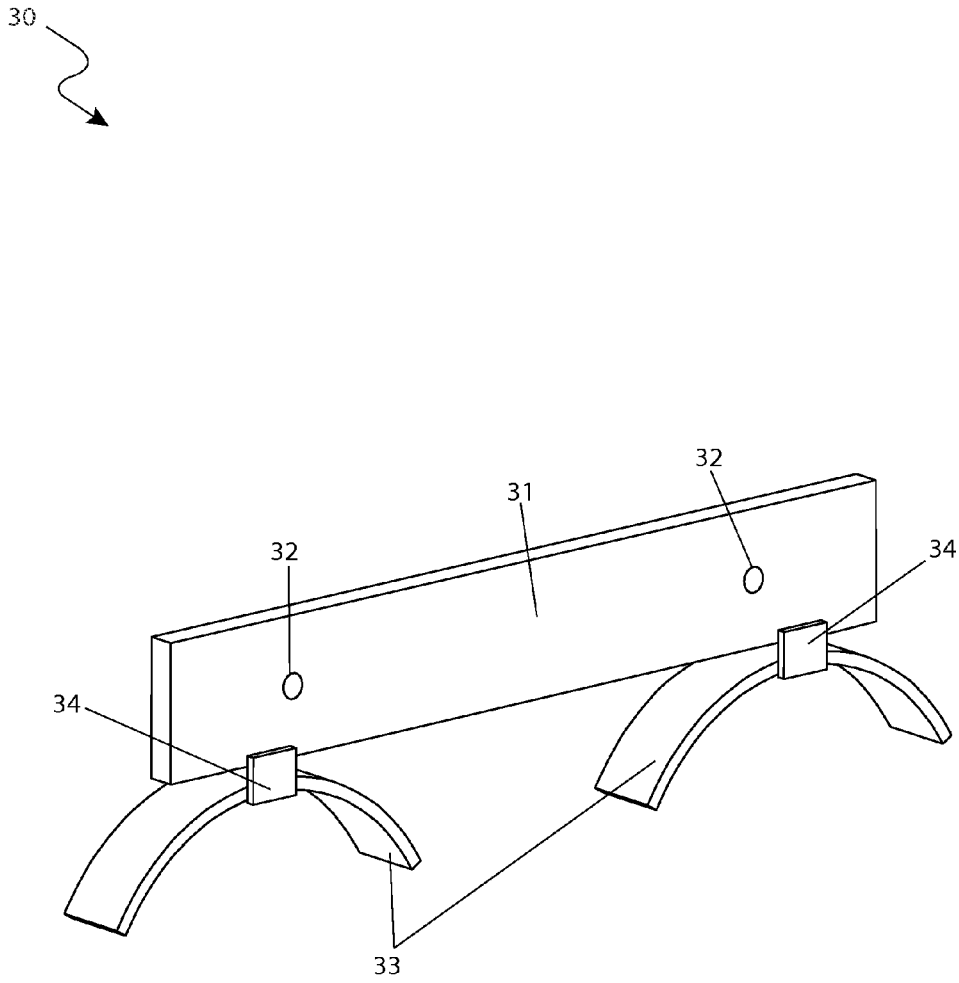
FIG. 4 is a front perspective view of a first bracket 30, according to a preferred embodiment.
Figure 5:
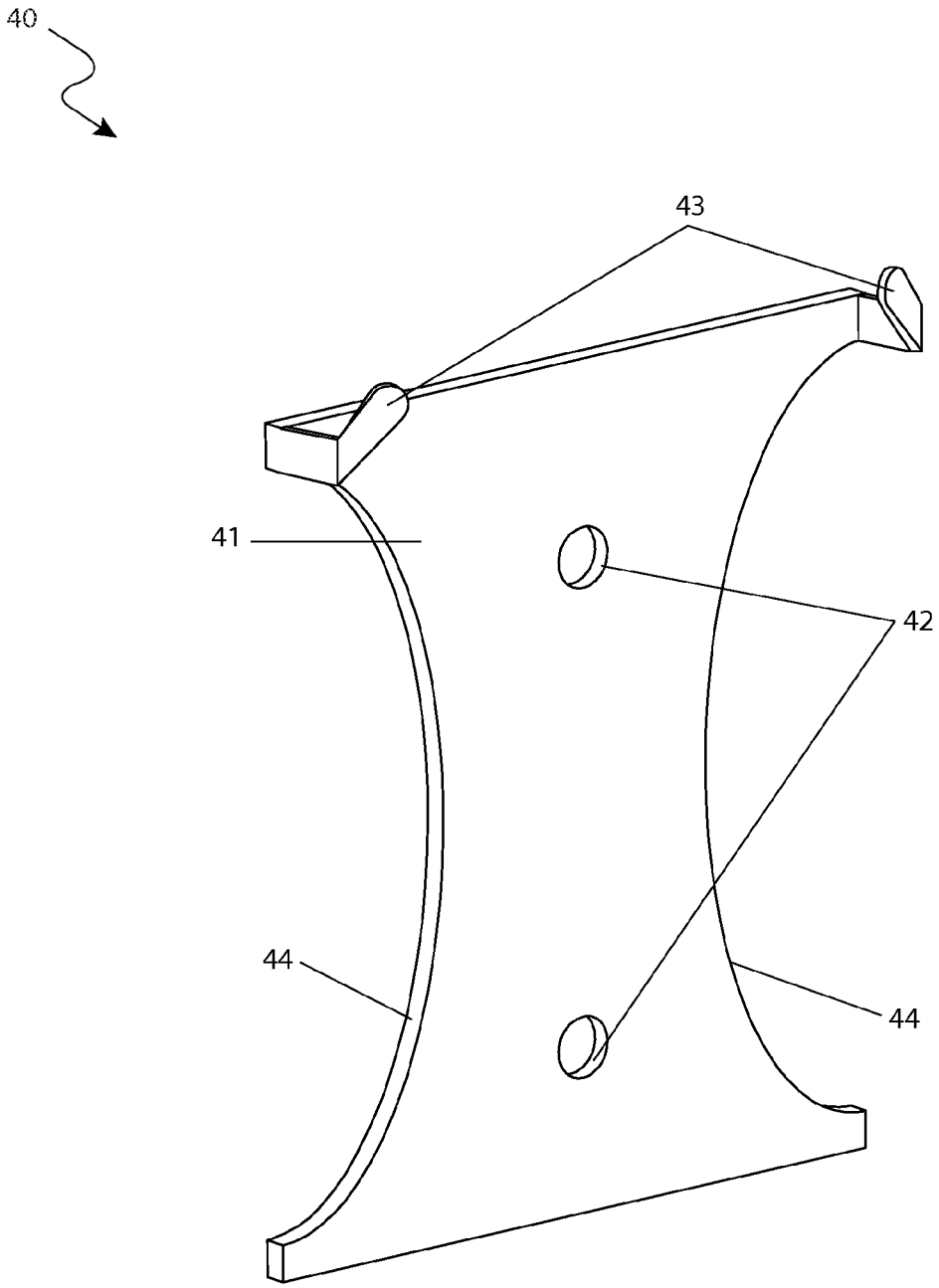
FIG. 5 is a front perspective view of a second bracket 40, according to a preferred embodiment.
Figure 6:
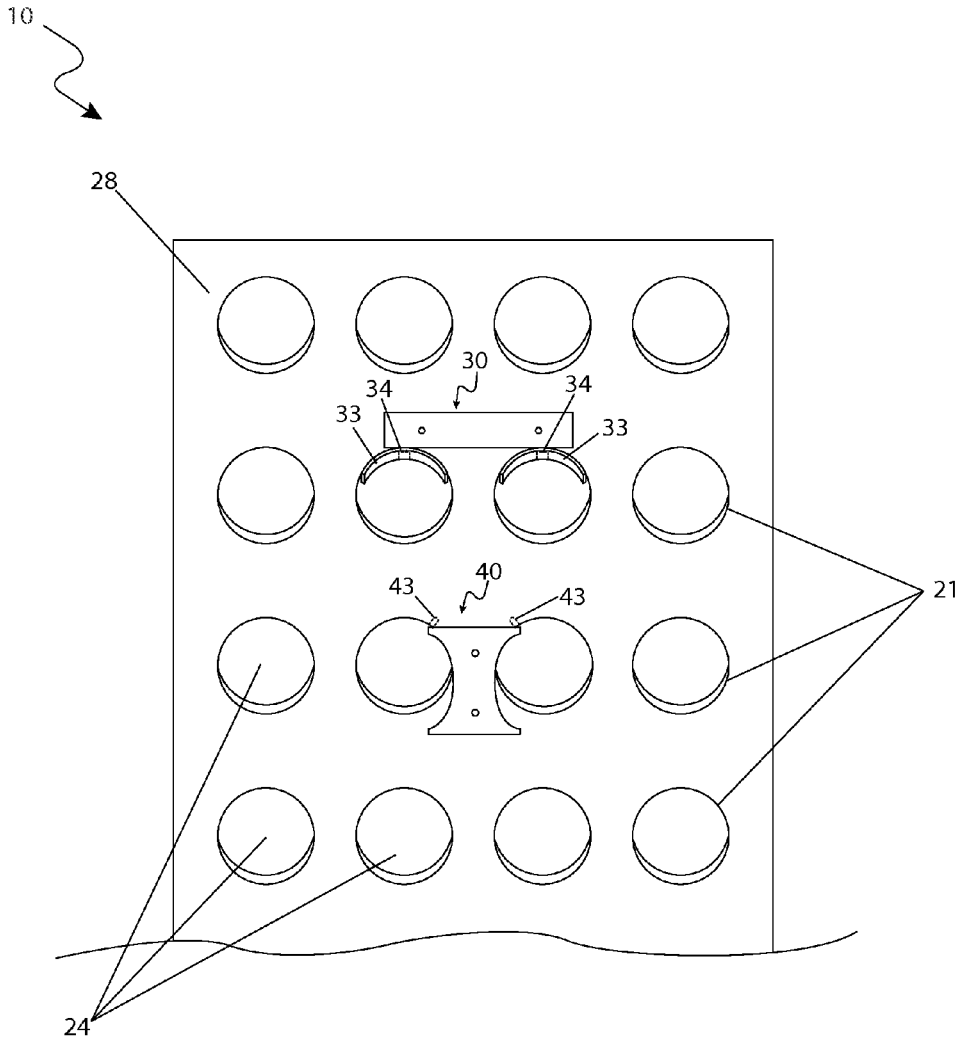
FIG. 6 is a rear view of the canister organizer 10 depicting a preferred placement of the first bracket 30 and second bracket 40, according to the preferred embodiment; and, FIG. 7 is an environmental view of the canister organizer 10 depicting an alternate method of installation 50.

Referring now to FIG. 3, a section view of the device 10 take along line A-A of FIG. 1; FIG. 4, a front perspective view of the first bracket 30; FIG. 5, a front perspective view of the second bracket 40; and, FIG. 6, a rear view of the device 10 depicting placement of the brackets 30, 40 are disclosed. The device 10 is suspended and attached to the desired vertical support surface 15 by a first bracket 30 and a second bracket 40. The brackets 30, 40 are preferably mounted to the support surface 15 by a plurality of mechanical fasteners suitable for attachment to the particular material of the support surface 15. The first bracket 30 receives and supports an upper perimeter edge of a pair of adjacent rear apertures 24 which secure the device 10 to the vertical support surface 15 in a flush manner. The second bracket 40 receives and supports an upper interior edge of a different pair of adjacent rear apertures 24. Preferably the second bracket 40 is positioned aligned with and below the first bracket 30. The brackets 30, 40 are fabricated from materials such as, but not limited to: metal, plastic, or the like and are fastened to the vertical support surface 15 by countersunk fasteners 45 which are preferably include mechanical fasteners such as screws, yet other securing means may be utilized without limiting the scope of the device 10. Although the device 10 is depicted as utilizing one (1) of each bracket 30, 40 it is understood that additional the brackets 30, 40 may be utilized dependant upon and corresponding with the overall dimensions of the device 10 and number of front and rear apertures 21, 24.

The first bracket 30 includes a rectangular first bracket body 31 which further includes a pair of first bracket apertures 32 which accept the fasteners 45. A front surface of the first bracket body 31 is positioned against the rear surface 23. Integrally molded to opposing front lower longitudinal surfaces of the first bracket body 31 is a pair of arcuate members 33 which receive and support the upper interior perimeter surface of the pair of side-by-side rear apertures 24 which are preferably located in a central portion of the rear surface 23, thereby leveling the device 10. The arcuate members 33 include a downward curvature equal to the upper half of the curvature of the rear apertures 24 which enables seamless mating of the first bracket 30 to the pair of rear apertures 24. The arcuate members 33 include a first bracket tab 34 which further secures the rear surface 23 of the structure to the first bracket 30. Each first bracket tab 34 is integrally molded to a center pinnacle outer perimeter surface of each arcuate member 33 and is positioned against a front portion of the rear surface and prohibits the device 10 from sliding off of the first bracket 30.

The second bracket 40 includes a rectangular second bracket body 41 which further includes a pair of second bracket apertures 42 which accept the fasteners 45 for securing the bracket 40 to the desired vertical support surface 15. The second bracket 40 is preferably positioned below and vertically aligned with the first bracket 30. Opposing lateral edges of the second bracket body 41 include arcuate edges 44 which include a curvature equal to the side portions of the curvature of the rear apertures 24 which conceals the second bracket structure 41. The second bracket 40 also includes a pair of second bracket tabs 43 which engage and support the upper interior perimeter surfaces of the respective rear apertures 24. The second bracket tabs 43 are integrally molded to the second bracket body 41 and protrude outwardly from opposing upper perimeter ends of the second bracket body 41. Each second bracket tab 43 has a generally L-shape and protrudes outwardly and upwardly at a slight angle which enables the second bracket 40 to engage the rear apertures 24, thereby providing additional support for suspending the structure.

Figure 7:
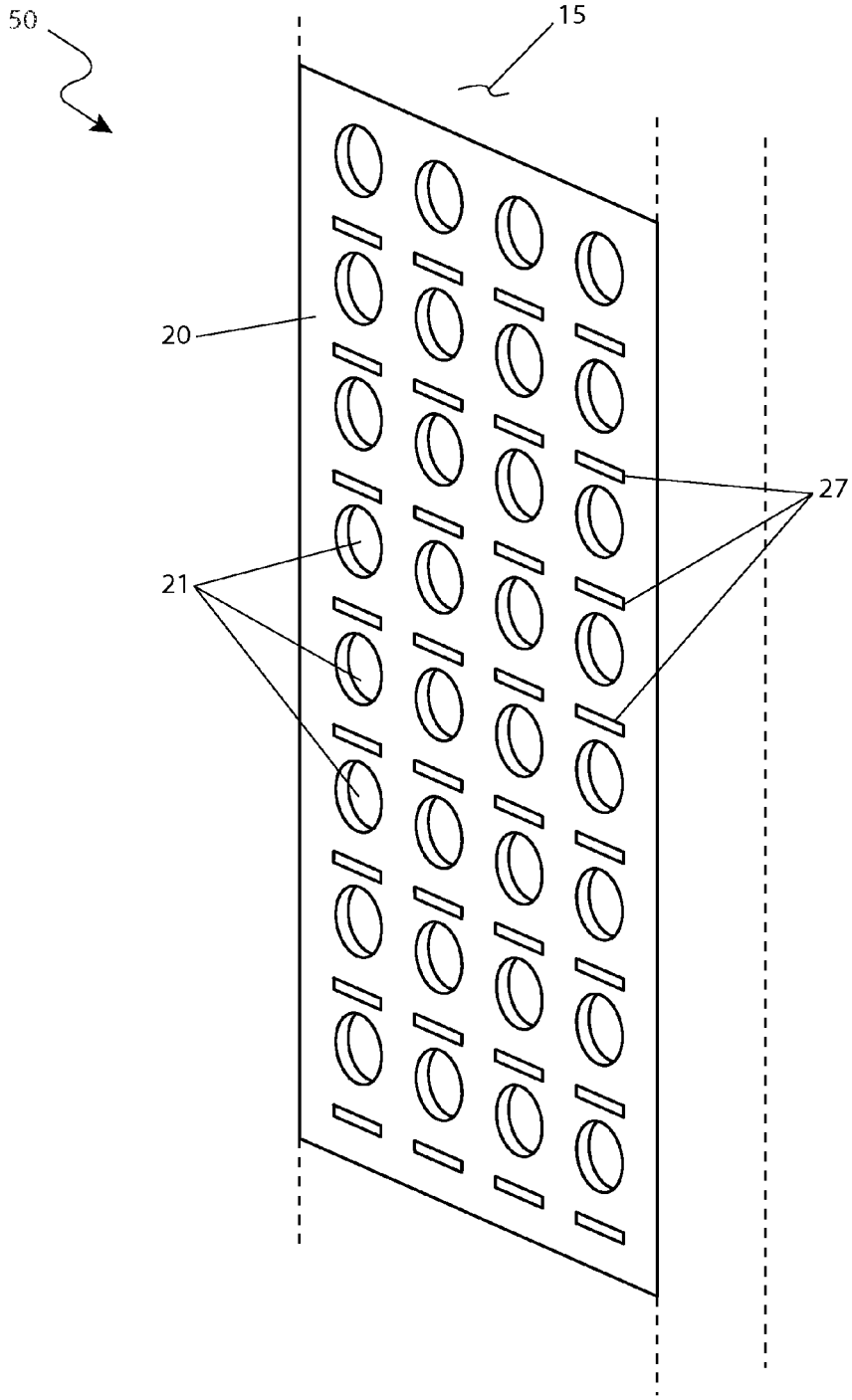

Referring now to FIG. 7, another environmental view of the device 10 depicting an alternate method of installation 50 is disclosed. FIG. 7 illustrates the device 10 being mounted within a recessed cavity in the vertical support surface 15, thereby positioning the device 10 flush with the surface 15. In this manner, the brackets 30, 40 are attached to the existing wall studs and the device 10 is framed with drywall or other wall materials. The alternate method of installation 50 enables the device 10 to occupy less space upon the vertical surface 15.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIG. 1 and alternately within FIG. 7.

The method of utilizing the device 10 may be achieved by performing the following steps: acquiring the device 10; inserting fasteners 45 into the first bracket apertures 32 and onto the desired vertical surface 15 with the first bracket tabs 34 positioned in an upward orientation and in a level manner; inserting fasteners 45 into the second bracket apertures 42 with the feet 43 oriented upwardly and positioned below the first bracket 30 which is also spaced equally to engage the rear apertures 24; engaging the respective rear apertures 24 upon the arcuate members 33 further engaging the first bracket tabs 34 on the first bracket 30 and simultaneously engaging each second bracket tab 43 on the second bracket 40 with rear apertures subjacent to the first bracket 30; positioning canisters 16 within the front apertures 21 and engaging with a respective rear aperture 24; positioning desired descriptive means within desired label slots 27; and, providing a method of holding and displaying canisters 16 in an arrangement that not only keeps them readily accessible, but easily identifiable as well.

The method of utilizing the alternate method of installation 50 may be achieved by performing the following steps: acquiring the device 10; inserting fasteners 45 into the first bracket apertures 32 and onto the desired wall studs with the first bracket tabs 34 positioned in an upward orientation and in a level manner; inserting fasteners 45 into the second bracket apertures 42 with the feet 43 oriented upwardly and positioned below the first bracket 30 which is also spaced equally to engage the rear apertures 24; engaging the respective rear apertures 24 upon the arcuate members 33 further engaging the first bracket tabs 34 on the first bracket 30 and simultaneously engaging each second bracket tab 43 on the second bracket 40 with rear apertures subjacent to the first bracket 30; framing the device 10 with drywall or the like; positioning canisters 16 within the front apertures 21 and engaging with a respective rear aperture 24; positioning desired descriptive means within desired label slots 27; and, providing a method of holding and displaying canisters 16 in an arrangement that not only keeps them readily accessible, but easily identifiable as well.

The method of utilizing the device 10 upon a horizontal surface may be achieved by performing the following steps: acquiring the device 10; positioning the device 10 upon a desired horizontal surface such as a work table, desk, or the like; positioning canisters 16 within the front apertures 21 and engaging with a respective rear aperture 24; positioning desired descriptive means within desired label slots 27; and, providing a method of holding and displaying canisters 16 in an arrangement that not only keeps them readily accessible, but easily identifiable as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. An organizer for storing and displaying canisters having a generally cylindrical body including a diameter and a length, said organizer comprising:

a support structure having a hollow interior, further having a front surface, a rear surface opposite said front surface, an opposing pair of side surfaces, a top surface, and a bottom surface opposite said top surface;

at least one circular front aperture disposed through said front surface having a diameter greater than a canister diameter for receiving said canister;

at least one circular rear aperture disposed through said rear surface having a diameter greater than said canister diameter for receiving said canister; and, at least one first bracket for engaging a selected one of said at least rear one aperture, said at least one first bracket mounted to a vertical support surface;

wherein said rear aperture is generally aligned with said front aperture;

wherein said first bracket further comprises:

a rectangular first bracket body;

at least one first bracket aperture for receiving a fastener for attaching said first bracket to said support surface;

at least one arcuate member affixed to and protruding from a lower longitudinal edge of said first bracket body; and, a first bracket tab protruding upwardly from an central upper edge of said arcuate member;

wherein said at least one arcuate member engages and supports an upper interior perimeter edge of said selected rear aperture; and, wherein said first bracket tab engages an interior side of said rear surface;

wherein said support structure is removably mounted to said at least one first bracket in an upright and vertical position; and, whereby when said support structure is in said upright and vertical position said canister can be inserted through a selected front aperture and into an aligned rear aperture such that said canister is cooperatively supported by said front surface and said rear surface in a generally horizontal position, wherein an inserted end of said canister is limited by said support surface.

2. The organizer of claim 1, wherein said at least one rear aperture is slightly downwardly offset from a correspondingly aligned front aperture, such that said canister is cooperatively supported by said front surface and said rear surface in a horizontally sloped position.

3. The organizer of claim 1, wherein said arcuate member further comprises a thickness equivalent to a thickness of said rear surface.

4. The organizer of claim 1, wherein said front surface further comprises a plurality of front apertures and said rear surface further comprises an equivalent plurality of rear apertures for accommodating a plurality of canisters.

5. The organizer of claim 4, wherein said first bracket further comprises:

a rectangular first bracket body;

at least one first bracket aperture for receiving a fastener for attaching said first bracket to said support surface;

a pair of arcuate members affixed to and protruding from opposing ends of a lower longitudinal edge of said first bracket body; and, a first bracket tab protruding upwardly from an central upper edge of each of said pair of arcuate members;

wherein said pair of arcuate members further comprise a thickness equivalent to a thickness of said rear surface and engage and support an upper interior perimeter edge of a first adjacent pair of rear apertures; and, said first bracket tab engages an interior side of said rear surface.

6. The organizer of claim 5, wherein each of said plurality of rear apertures is slightly downwardly offset from a correspondingly aligned front aperture, such that said canister is cooperatively supported by said front surface and said rear surface in a horizontally sloped position.

7. The organizer of claim 4, further comprising at least one second bracket mounted to said vertical support surface for engaging a second pair of adjacent rear apertures.

8. The organizer of claim 7, wherein said second bracket further comprises:

a rectangular second bracket body;

at least one second bracket aperture for receiving a fastener for attaching said second bracket to said support surface; and, a pair of second bracket tabs protruding from opposing ends of an upper edge of said second bracket body;

wherein said pair of second bracket tabs support an upper interior perimeter portion of a pair of adjacent rear apertures and engages an interior surface of said rear surface.

9. The organizer of claim 8, wherein said pair of second bracket tabs protrudes outwardly from said second bracket body a distance equivalent to a thickness of said rear surface.

10. The organizer of claim 9, wherein said second bracket further comprises arcuate opposing side edges having an inwardly curved profile that substantially matches curved side portions of said lower pair of adjacent rear apertures.

11. The organizer of claim 10, wherein each of said plurality of rear apertures is slightly downwardly offset from a correspondingly aligned front aperture, such that said canister is cooperatively supported by said front surface and said rear surface in a horizontally sloped position.

12. The organizer of claim 4, further comprising a label slot affixed to an exterior side of said front surface adjacent to each of said plurality of first front apertures, said label slot comprising a transparent sleeve suitable to receive a descriptive indicia for identifying contents of said canister.

13. An organizer for storing and displaying a plurality of canisters having a generally cylindrical body including a diameter and a length, said organizer comprising:

a support structure having a hollow interior, further having a front surface, a rear surface opposite said front surface, an opposing pair of side surfaces, a top surface, and a bottom surface opposite said top surface;

a plurality of circular front apertures disposed through said front surface having a diameter greater than a canister diameter for receiving said plurality of canisters;

a plurality of circular rear apertures disposed through said rear surface having a diameter greater than said canister diameter for receiving said plurality of canisters;

at least one first bracket for engaging a selected upper pair of adjacent rear apertures, said at least one first bracket mounted to a vertical support surface; and, at least one second bracket for engaging a selected lower pair of adjacent rear apertures, said at least one second bracket mounted to a vertical support surface;

wherein said plurality of rear apertures are generally aligned with said plurality of front apertures;

wherein said support structure is removably mounted to said at least one first bracket and said at least one second bracket in an upright and vertical position;

wherein said first bracket further comprises:

a rectangular first bracket body;

at least one first bracket aperture for receiving a fastener for attaching said first bracket to said support surface;

a pair of arcuate members affixed to and protruding from opposing ends of a lower longitudinal edge of said first bracket body; and, a first bracket tab protruding upwardly from an central upper edge of each of said pair of arcuate members;

wherein said pair of arcuate members further comprise a thickness equivalent to a thickness of said rear surface and engage and support an upper interior perimeter edge of said upper adjacent pair of rear apertures; and, wherein said first bracket tab engages an interior side of said rear surface; and, whereby when said support structure is in said upright and vertical position said canister can be inserted through a selected front aperture and into an aligned rear aperture, such that said canister is cooperatively supported by said front surface and said rear surface in a generally horizontal position, wherein an inserted end of said canister is limited by said support surface.

14. The organizer of claim 13, wherein said second bracket further comprises:

a rectangular second bracket body;

at least one second bracket aperture for receiving a fastener for attaching said second bracket to said support surface; and, a pair of second bracket tabs protruding from opposing ends of an upper edge of said second bracket body;

wherein said pair of second bracket tabs protrude outwardly from said second bracket body a distance equivalent to a thickness of said rear surface and support an upper interior perimeter portion of a lower pair of adjacent rear apertures and engages an interior surface of said rear surface.

15. The organizer of claim 14, wherein each of said plurality of rear apertures is slightly downwardly offset from a correspondingly aligned front aperture, such that said canister is cooperatively supported by said front surface and said rear surface in a horizontally sloped position.

16. The organizer of claim 15, further comprising a label slot affixed to an exterior side of said front surface adjacent to each of said plurality of first apertures, said label slot comprising a transparent sleeve suitable to receive a descriptive indicia for identifying contents of said canister.

17. The organizer of claim 16, wherein said second bracket further comprises arcuate opposing side edges having an inwardly curved profile that substantially matches curved side portions of said lower pair of adjacent rear apertures.

18. The organizer of claim 17, further comprising a plurality of first brackets for engaging and supporting multiple upper pairs of adjacent rear apertures and a plurality of second brackets for engaging and supporting multiple lower pairs of adjacent rear apertures;

wherein a second bracket is positioned parallel to and below a corresponding first bracket.

* * * * *